US008801213B2

(12) United States Patent
Matsushima et al.

(10) Patent No.: US 8,801,213 B2
(45) Date of Patent: Aug. 12, 2014

(54) LIGHTING DEVICE HAVING FIRST AND SECOND ORGANIC ELECTROLUMINESCENCE ELEMENT MODULES

(71) Applicant: Panasonic Corporation, Osaka (JP)

(72) Inventors: Megumi Matsushima, Osaka (JP); Masaki Tada, Tokyo (JP); Kiminori Sato, Chiba (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/746,706

(22) Filed: Jan. 22, 2013

(65) Prior Publication Data

US 2013/0193841 A1 Aug. 1, 2013

(30) Foreign Application Priority Data

Jan. 26, 2012 (JP) ..... 2012-013723
Feb. 7, 2012 (JP) ..... 2012-024368

(51) Int. Cl.
*F21S 8/00* (2006.01)

(52) U.S. Cl.
USPC ..... 362/147; 362/362; 362/249.06

(58) Field of Classification Search
USPC ..... 362/147, 148, 150, 249.02, 257, 317, 362/490, 84, 249.06, 311.14, 362, 804; 313/504, 112
See application file for complete search history.

(56) References Cited

U.S. PATENT DOCUMENTS 5,964,521 A * 10/1999 Caya ..... 362/344
6,740,190 B2 * 5/2004 Takase ..... 156/267
2004/0042199 A1 3/2004 Cok
2005/0162069 A1 * 7/2005 Ota et al. ..... 313/501
2007/0230208 A1 * 10/2007 Plank et al. ..... 362/573
2008/0007938 A1 * 1/2008 Chou et al. ..... 362/97
2010/0307075 A1 * 12/2010 Zampini et al. ..... 52/173.1
2011/0235318 A1 9/2011 Simon et al.
2011/0273886 A1 11/2011 Lu et al.
2013/0039041 A1 * 2/2013 Yeh et al. ..... 362/147
2013/0135870 A1 * 5/2013 Yokosawa ..... 362/253

FOREIGN PATENT DOCUMENTS

DE 202006005427 7/2006
EP 2410235 1/2012
JP 2008-204893 9/2008
JP 2009-170249 7/2009
JP 2010-257864 11/2010

OTHER PUBLICATIONS

Search report from E.P.O., mail date is May 13, 2013.

* cited by examiner

*Primary Examiner* — Sikha Roy
*Assistant Examiner* — Glenn Zimmerman
(74) *Attorney, Agent, or Firm* — Greenblum & Bernstein P.L.C.

(57) ABSTRACT

A lighting device includes a device body adapted to be installed on a surface of a room and first organic electroluminescence element modules including organic electroluminescence elements, the first electroluminescence element modules being held in the device body with light-emitting surfaces of the electroluminescence elements facing toward the surface of the room when the device body is installed on the surface of the room. The lighting device further includes a light-transmitting protection cover configured to cover the light-emitting surfaces of the first organic electroluminescence element modules.

4 Claims, 5 Drawing Sheets

LIGHTING DEVICE HAVING FIRST AND SECOND ORGANIC ELECTROLUMINESCENCE ELEMENT MODULES

FIELD OF THE INVENTION

The present invention relates to a lighting device in which an organic electroluminescence element is used as a light source.

BACKGROUND OF THE INVENTION

In recent years, there has been proposed a lighting device using an organic electroluminescence element as a light source (see, e.g., Japanese Patent Application Publication No. 2009-170249).

JP2009-170249A discloses a lighting device 60 configured as shown in FIG. 6.

The lighting device 60 includes a device body 62, a support pipe 63 for supporting the device body 62, and a fixing portion 64 for fixing the device body 62 through the support pipe 63.

The device body 62 includes a plurality of organic electroluminescence panels (hereinafter referred to as "organic EL panels") 61, a support frame 65 for supporting the organic EL panels 61, and a cover member 66 for covering the organic EL panels 61 supported on the support frame 65.

In this regard, JP2009-170249A discloses that the lighting device 60 is fixed to a ceiling 67 by the fixing portion 64. JP2009-170249A further discloses that the light is irradiated from the respective organic EL panels 61 toward a floor surface within a room.

In the lighting device 60 suspended from the ceiling 67, it is possible to illuminate the space existing below the device body 62 because the light is irradiated from the respective organic EL panels 61 toward the floor surface within the room.

In the lighting device 60, however, no consideration is given to the distribution of the light from the respective organic EL panels 61 toward the upper side of the device body 62. Thus the space existing above the device body 62 may possibly become dark.

In view of this, the present inventors have conceived that, in the lighting device 60 suspended from the ceiling 67, the organic EL panels 61 are arranged at the upper side of the support frame 65 in order to distribute the light toward the upper side of the device body 62. Moreover, it has come to the attention of the present inventors that, in the lighting device 60, dust or the like is deposited on the organic EL panels 61 arranged at the upper side of the support frame 65. The dust thus deposited absorbs moisture existing in the air. The degradation of the organic EL panels 61 (the reduction of the light quantity or the shortened lifespan of the organic EL panels 61) may be caused by the moisture.

SUMMARY OF THE INVENTION

In view of the above, the present invention provides a lighting device capable of distributing light toward the upper side of a device body and capable of suppressing degradation of an organic electroluminescence element module.

In accordance with one aspect of the present invention, there is provided a lighting device including: a device body adapted to be installed on a surface of a room; first organic electroluminescence element modules including organic electroluminescence elements, the first electroluminescence element modules being held in the device body with the light-emitting surfaces of the electroluminescence elements facing toward the surface of the room when the device body is installed on the surface of the room; and a light-transmitting protection cover configured to cover the light-emitting surfaces of the first organic electroluminescence element modules.

The lighting device of the present invention further includes second organic electroluminescence element modules including organic electroluminescence elements, the second organic electroluminescence element modules being held in the device body with light-emitting surfaces of the organic electroluminescence elements facing toward an inside of the room opposite to the surface of the room when the device body is installed on the surface of the room, wherein the first organic electroluminescence element modules are smaller in row number than the second organic electroluminescence element modules.

With the present lighting device, it is possible to distribute light toward the upper side of a device body and to suppress degradation of an organic electroluminescence element module.

It is also possible to provide a lighting device including semiconductor light-emitting elements on the front and rear surfaces of the lighting device, which is capable of reducing glare of a ceiling surface and capable of providing good illumination effect and mood.

DETAILED DESCRIPTION OF THE EMBODIMENTS

A lighting device in accordance with the present embodiment will now be described with reference to FIGS. 1 through 5.

The lighting device of the present embodiment is a pendant light and includes a device body 20 and a semiconductor light-emitting element module (e.g., an organic electroluminescence element module 1) having semiconductor light-emitting elements (e.g., organic electroluminescence elements). Description on the organic electroluminescence element module (hereinafter referred to as "organic EL module") 1 will precede description on the lighting device provided with the organic EL module 1.

The organic EL module 1 is formed into a plate shape (a substantially rectangular plate shape in the present embodiment).

Figure 4:
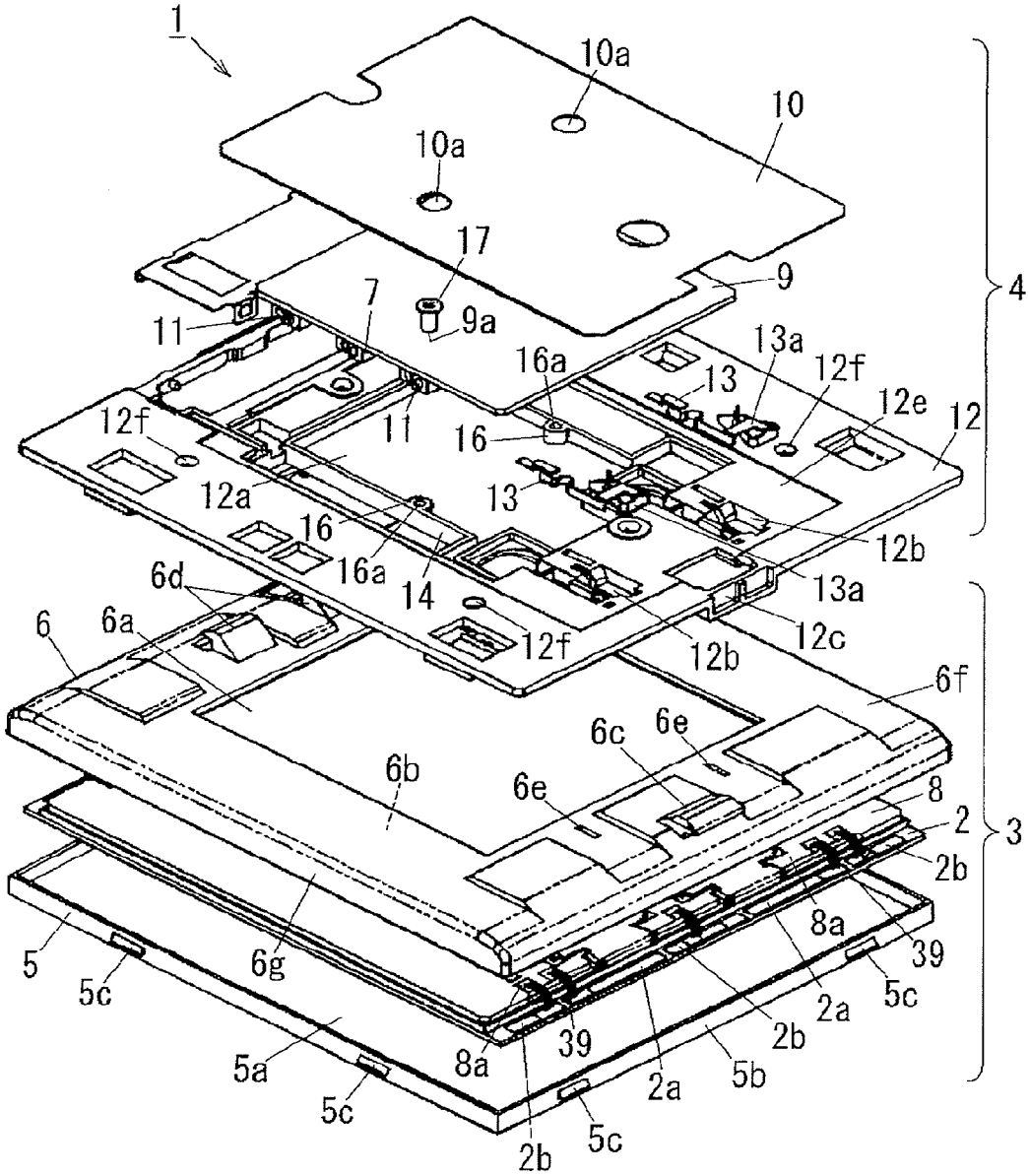
FIG. 4 is an exploded perspective view showing an organic electroluminescence element module of the lighting device.

As shown in FIG. 4, the organic EL module 1 includes a light source unit 3 having a light-emitting panel 2 formed of the aforementioned organic electroluminescence element, and a base unit 4 to which the light source unit 3 can be detachably attached. The base unit 4 is used to attach the organic EL module 1 to the device body 20.

The light source unit 3 includes not only the light-emitting panel 2 but also a wiring substrate 8 arranged at the opposite side of the light-emitting panel 2 from the light emitting side (the lower surface side in FIG. 4) and electrically connected to the light-emitting panel 2. The light source unit 3 further includes a case 6 for covering the opposite surface of the wiring substrate 8 from the light-emitting panel 2, and a cover 5 attached to the case 6 so as to cover the light emitting surface side of the light-emitting panel 2. While the outer periphery shape of the light-emitting panel 2 is rectangular in the present embodiment, the present invention is not particularly limited to this shape.

The light-emitting panel 2 includes a light-transmitting base member (not shown) having a plate shape (a rectangular plate shape in the present embodiment), and a light-emitting body (not shown) having a plate shape (a rectangular plate shape in the present embodiment). The light-emitting body is arranged on one surface of the base member and includes a light-emitting layer (not shown). In the present embodiment, the outer periphery of the light-emitting body is smaller than the outer periphery of the base member.

The light-emitting body includes a first electrode (not shown) formed on the base member, the light-emitting layer formed on the first electrode and a second electrode (not shown) formed on the light-emitting layer. In the present embodiment, the first electrode is formed of a transparent conductive film, making up a positive electrode. In the present embodiment, the second electrode is formed of, e.g., an aluminum film, making up a negative electrode. In this regard, the aluminum film also serves as a reflection film.

The light-emitting panel 2 includes an encapsulating portion (not shown) covering the light-emitting body and attached to the base member. In the present embodiment, the other surface of base member becomes the light-emitting surface of the light-emitting panel 2. In the present embodiment, the light-emitting color of the light-emitting panel 2 is white but may be other colors.

The light-emitting panel 2 includes a plurality of (six, in the present embodiment) first terminal portions 2*b* provided at the opposite side of the light-emitting panel 2 from the light-emitting surface side (at the upper surface side of the light-emitting panel 2 in FIG. 4) and electrically connected to the first electrode. In the present embodiment, the first terminal portions 2*b* are arranged in the opposite end portions (the left upper end portion and the right lower end portion in FIG. 4) of the opposite side of the light-emitting panel 2, three at each of the opposite end portions.

The light-emitting panel 2 further includes a plurality of (four, in the present embodiment) second terminal portions 2*a* provided at the opposite side of the light-emitting panel 2 from the light-emitting surface side and electrically connected to the second electrode. In the present embodiment, the second terminal portions 2*a* are arranged in the opposite end portions (the left upper end portion and the right lower end portion in FIG. 4) of the opposite side of the light-emitting panel 2, two at each of the opposite end portions.

The wiring substrate 8 is formed of a printed wiring substrate in which a first conductor pattern (not shown) is formed on an insulating base member made of, e.g., a glass epoxy resin. In the present embodiment, the wiring substrate 8 is formed into a rectangular frame shape.

The wiring substrate 8 includes a plurality of (ten, in the present embodiment) lands 8*a* arranged at the opposite side of the wiring substrate 8 from the light-emitting panel and electrically connected to the respective terminal portions 2*a* and 2*b* of the light-emitting panel 2. The lands 8*a* are formed of a portion of the first conductor pattern. In the present embodiment, the lands 8*a* are arranged in the opposite end portions (the left upper end portion and the right lower end portion in FIG. 4) of the opposite side of the wiring substrate 8 from the light-emitting panel 2, five in each of the opposite end portions.

In the organic EL module 1 of the present embodiment, the respective lands 8*a* of the wiring substrate 8 are electrically connected to the corresponding terminal portions 2*a* and 2*b* by electric connection portions 39 having electric conductivity. While a wire is employed as the electric connection portion 39 in the present embodiment, the present invention is not limited thereto. It may be possible to employ, e.g., a lead line.

Figure 5:
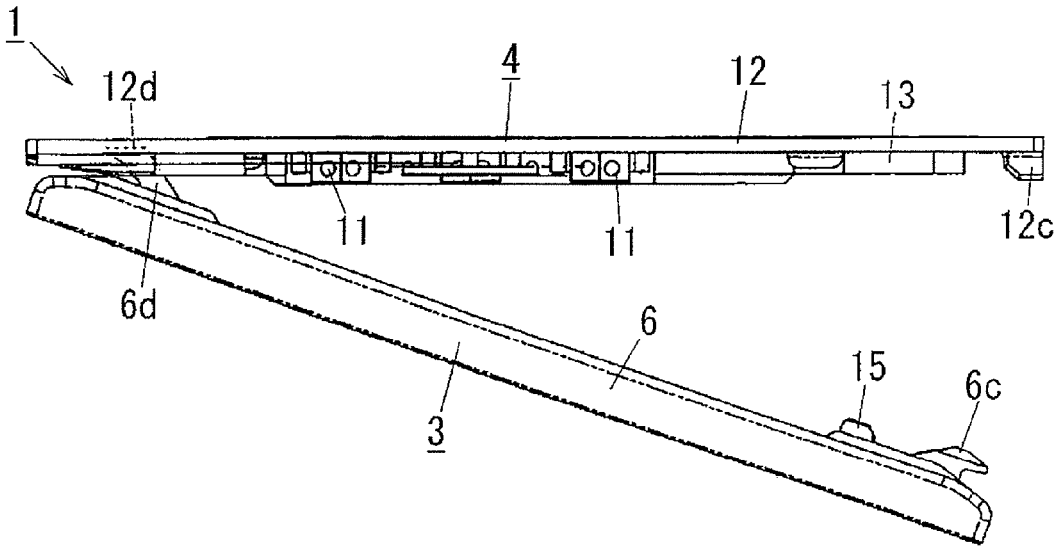
FIG. 5 is an explanatory view illustrating a method of assembling the organic electroluminescence element module of the lighting device.
Figure 6:
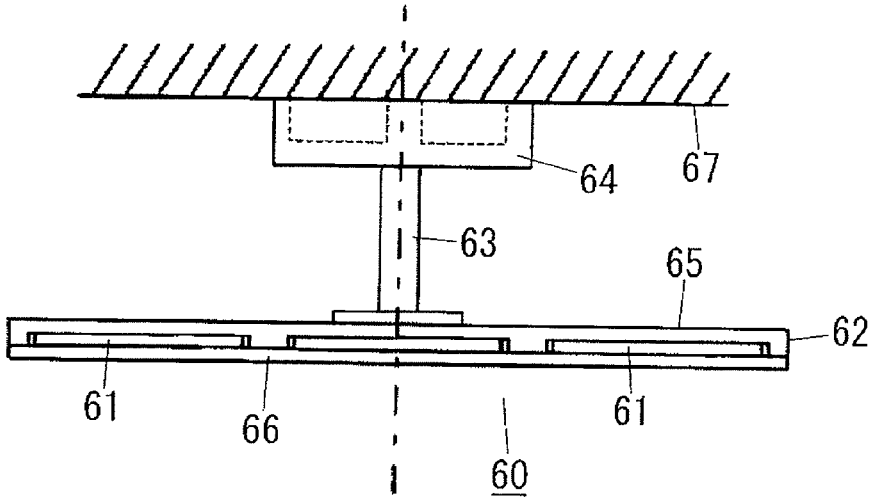
FIG. 6 is a schematic side view showing a conventional lighting device.

The wiring substrate 8 further includes a pair of power feeding terminals 15 (see FIG. 5) protruding from the opposite side of the wiring substrate 8 from the light-emitting panel 2. The power feeding terminals 15 are electrically connected to the corresponding lands 8*a*. In the present embodiment, the power feeding terminals 15 are electrically connected to the respective lands 8*a* with a portion of the first conductor pattern of the wiring substrate 8 interposed therebetween. Only one of the power feeding terminals 15 is shown in FIG. 5.

In the organic EL module 1 of the present embodiment, the light-emitting panel 2 and the wiring substrate 8 are bonded to each other by, e.g., a tape having an adhesive agent applied on the opposite surfaces thereof.

The case 6 is formed into a flat box shape (a rectangular box shape in the present embodiment) having an open surface at the side of the light-emitting panel 2 (at the lower side in FIG. 4). In the present embodiment, the case 6 can be made of, e.g., a synthetic resin material having an electric insulation property.

The case 6 includes a bottom wall 6*f* and a first recess portion 6*a* formed in the central region of the bottom wall 6*f* to be depressed toward the light-emitting panel 2. In the organic EL module 1 of the present embodiment, the inner periphery of the first recess portion 6*a* is formed into a rectangular shape. In the present embodiment, the surface of the peripheral region of the bottom wall 6*f* of the case 6 facing the light-emitting panel 2 defines a storage portion 6*b* for storing the wiring substrate 8.

A pair of lead-out holes 6*e* for leading out the power feeding terminals 15 therethrough is formed in the positions corresponding to the power feeding terminals 15 of the wiring substrate 8 so as to extend through the peripheral region of the bottom wall 6*f* of the case 6.

A pair of first engaging claws 6*d* for bringing the case 6 into engagement with the base unit 4 in a removable manner is formed in one end portion (the left upper portion in FIG. 4) of the bottom wall 6*f* of the case 6 at the opposite side of the case 6 from the light-emitting panel 2. A second engaging claw 6*c* for bringing the case 6 into engagement with the base unit 4 in a removable manner is formed in the other end portion (the right lower portion in FIG. 4) of the bottom wall 6*f* of the case 6 at the opposite side of the case 6 from the light-emitting panel 2.

The cover 5 is formed into a flat box shape (a substantially rectangular box shape in the present embodiment). The cover 5 has a storage portion 5*a* for storing the light-emitting panel 2. The storage portion 5*a* is formed at the side of the light-emitting panel 2 (at the upper side of the cover 5 in FIG. 4). In the present embodiment, the cover 5 is made of a light-transmitting material. As the light-transmitting material, it is possible to use a light-transmitting resin (e.g., an ABS resin, an acryl resin or a polystyrene resin). While the light-transmitting resin is used as the light-transmitting material in the present embodiment, the present invention is not limited thereto. It may be possible to use, e.g., a glass.

A plurality of (eight, in the present embodiment) fitting claws 5*c* for attaching the cover 5 to the case 6 is arranged on the outer surface of the sidewall 5*b* of the cover 5. A plurality of fitting grooves (not shown) for engaging with the fitting claws 5*c* is formed on the inner surface of the sidewall 6*g* of the case 6 in the positions corresponding to the respective fitting claws 5*c* of the cover 5. In the organic EL module 1 of the present embodiment, the cover 5 is attached to the case 6 by bringing the fitting claws 5*c* of the cover 5 into engagement with the engaging grooves of the case 6.

The base unit 4 includes a circuit board 9 having a lighting circuit (not shown) for turning on the light-emitting panel 2, and a pair of terminal reception portions 13 electrically connected to the circuit board 9. The power feeding terminals 15 of the light source unit 3 can be removably inserted into the terminal reception portions 13. The base unit 4 further includes a housing 12 for accommodating the circuit board 9 and the terminal reception portions 13 and a protection member 10 for protecting the circuit board 9 and the terminal reception portions 13 accommodated within the housing 12.

The circuit board 9 is formed of a printed wiring board in which a suitable second conductor pattern (not shown) is formed on an insulating base member made of, e.g., a glass epoxy resin. While the outer periphery of the circuit board 9 is formed into a rectangular shape in the present embodiment, the present invention is not particularly limited to this shape.

Electronic parts (not shown) making up the lighting circuit are mounted on one surface (the lower surface in FIG. 4) of the circuit board 9. A pair of connectors 11 for receiving electric power from a power supply unit (not shown) installed on the upper surface of a ceiling member 40 (see FIG. 1) is mounted on the lower surface of one end portion (the left lower end portion in FIG. 4) of the circuit board 9. An input terminal 7 capable of inputting therethrough a signal for controlling the light output of the light-emitting panel 2 is mounted on the lower surface of the one end portion of the circuit board 9. In the organic EL module 1 of the present embodiment, the electronic parts, the connectors 11 and the input terminal 7 are electrically connected to a portion of the second conductor pattern. In the present embodiment, the lighting circuit includes a control circuit for controlling the light output of the light-emitting panel 2 in response to a control signal inputted from the input terminal 7.

Each of the terminal reception portions 13 is formed by bending a band-like metal plate.

A grip portion 13*a* capable of gripping each of the power feeding terminals 15 (see FIG. 5) led out from each of the lead-out holes 6*e* of the case 6 is formed in one end portion of each of the terminal reception portions 13. In the present embodiment, the other end portion of each of the terminal reception portions 13 is electrically connected to the circuit board 9 by a joint portion (not shown) made of, e.g., a solder.

The housing 12 is formed into a plate-like shape (a rectangular plate-like shape in the present embodiment). In the present embodiment, the housing 12 can be made of, e.g., a synthetic resin material having an electric insulation property.

A second recess portion 12*e* for accommodating the protection member 10 is formed in the central region of the housing 12.

A pair of through-holes 12*b*, into which the power feeding terminals 15 led out from the lead-out holes 6*e* are inserted, is formed in the peripheral region of the inner bottom wall of the second recess portion 12*e* of the housing 12. In the present embodiment, each of the grip portions 13*a* of the terminal reception portions 13 is arranged inside each of the through-holes 12*b*.

A third recess portion 12*a* for accommodating the circuit board 9 is formed in the central region of the inner bottom wall of the second recess portion 12*e* of the housing 12.

A support portion 14 for supporting the circuit board 9 protrudes from the inner bottom wall of the third recess portion 12*a* of the housing 12 in order to prevent the electronic parts of the circuit board 9 accommodated within the third recess portion 12*a* from making contact with the inner bottom wall of the third recess portion 12*a*. In the organic EL module 1 of the present embodiment, a plurality of (two, in the present embodiment) bosses 16 is formed in the support portion 14. Each of the bosses 16 has a fixing-screw hole 16*a* to which a fixing screw 17 for fixing the circuit board 9 to the housing 12 is threadedly coupled. In this regard, a first fixing-screw insertion hole 9*a*, into which the fixing screw 17 is inserted, is formed in the circuit board 9 in the position corresponding to the fixing-screw hole 16*a* of the housing 12.

A pair of first engaging portions 12*d* (see FIG. 5), with which the first engaging claws 6*d* engage in a removable manner, is formed in the positions corresponding to the first engaging claws 6*d* of the case 6 on the surface of the peripheral portion of the housing 12 facing the light-emitting panel 2. Only one of the first engaging portions 12*d* is shown in FIG. 5.

A second engaging portion 12*c*, with which the second engaging claw 6*c* engages in a removable manner, is formed in the position corresponding to the second engaging claw 6*c* of the case 6 on the surface of the peripheral portion of the housing 12 facing the light-emitting panel 2.

A plurality of (four, in the present embodiment) attachment insertion holes 12*f*, into which first attachment screws (not shown) for attaching the housing 12 to, e.g., the device body 20 (see FIG. 1) are inserted, are formed in the peripheral portion of the housing 12.

The protection member 10 is formed into a plate-like shape (a substantially rectangular plate-like shape in the present embodiment). In the present embodiment, the protection member 10 can be made of, e.g., a synthetic resin material having an electric insulation property.

A second fixing-screw insertion hole 10*a*, into which the fixing screw 17 is inserted, is formed in the protection member 10 in the position corresponding to the first fixing-screw insertion hole 9*a* of the circuit board 9. In the organic EL module 1 of the present embodiment, the protection member 10 and the circuit board 9 can be fixed to the housing 12 by inserting the fixing screw 17 into the fixing-screw insertion holes 10*a* and 9*a* of the protection member 10 and the circuit board 9 and threadedly coupling the fixing screw 17 to the fixing-screw hole 16*a* of the housing 12. In the organic EL module 1 of the present embodiment, it is therefore possible for the protection member 10 to cover the circuit board 9 and the terminal reception portions 13 accommodated within the housing 12, thereby protecting the circuit board 9 and the terminal reception portions 13.

An order of attaching the light source unit 3 to the base unit 4 in the organic EL module 1 of the present embodiment will now be described with reference to FIG. 5. Description will be made on the assumption that each of the light source unit 3 and the base unit 4 is assembled in advance.

First, the first engaging claws 6*d* of the light source unit 3 are brought into engagement with the first engaging portions 12*d* of the base unit 4. Then, the second engaging claw 6*c* of the light source unit 3 is approached toward the base unit 4 using the first engaging claws 6*d* as a fulcrum. The second engaging claw 6*c* of the light source unit 3 is brought into engagement with the second engaging portion 12*c* of the base unit 4, whereby the light source unit 3 can be attached to the base unit 4. In the organic EL module 1 of the present embodiment, if the light source unit 3 is attached to the base unit 4, the power feeding terminals 15 of the light source unit 3 are gripped by the terminal reception portions 13 of the base unit 4, so that the light source unit 3 and the base unit 4 are electrically connected to each other. In case where the light source unit 3 is removed from the base unit 4, the second engaging claw 6*c* of the light source unit 3 and the second engaging portion 12*c* of the base unit 4 are disengaged from each other. Thereafter, the first engaging claws 6*d* of the light source unit 3 and the first engaging portions 12*d* of the base unit 4 are disengaged from each other, whereby the light source unit 3 can be removed from the base unit 4.

Description will now be made on the components other than the organic EL module 1 of the lighting device in accordance with the present embodiment.

The device body 20 is formed into a box-like shape (a substantially rectangular box-like shape in the present embodiment). The device body 20 is formed from a metal plate, e.g., a steel plate. In the present embodiment, the surface of the device body 20 is coated with a silver coating material. In the lighting device in accordance with the present embodiment, it is therefore possible to give a reflection plate function to the device body 20. The material of the device body 20 is not limited to metal but may be, e.g., a synthetic resin.

In the lighting device of the present embodiment, a first recess portion 20*b* (see FIGS. 2A and 3A), in which the organic EL module 1 is arranged, is formed in the central region of the upper end portion of the device body 20. In the present embodiment, a second recess portion 20*a* (see FIGS. 2B, 3A, and 3B), in which the organic EL module 1 is arranged, is formed in the central region of the lower end portion of the device body 20.

Figure 1:
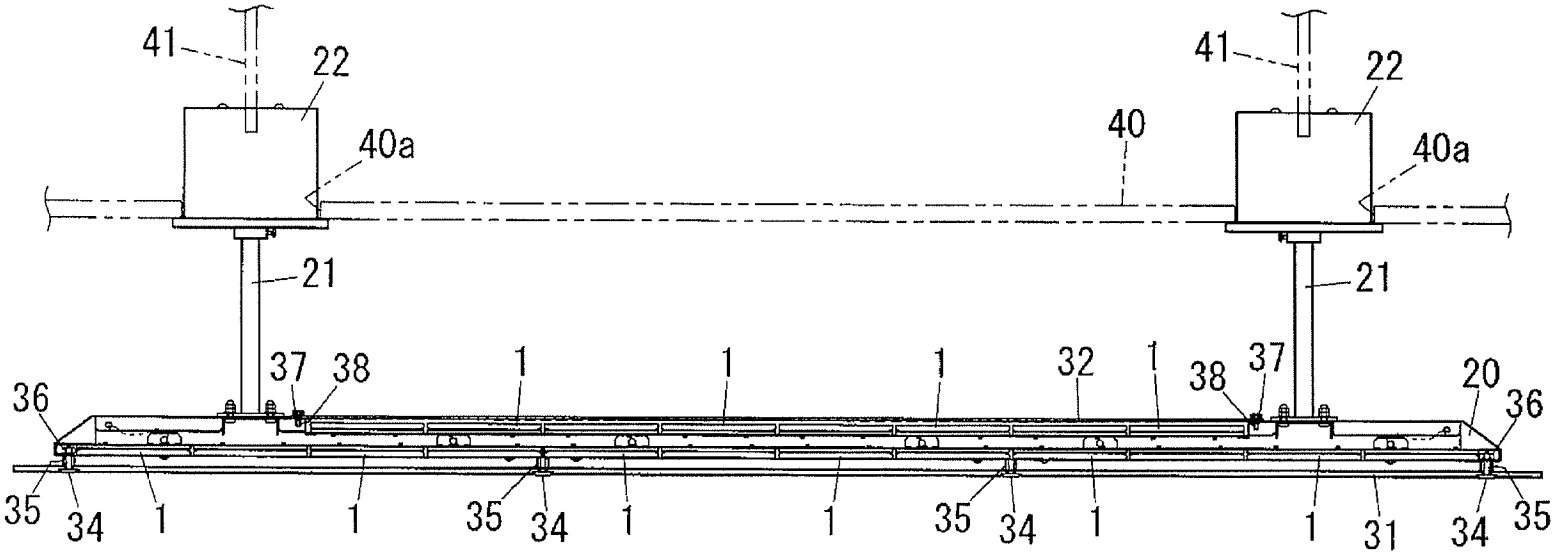
FIG. 1 is a schematic section view showing a lighting device according the present embodiment.
Figure 2A:
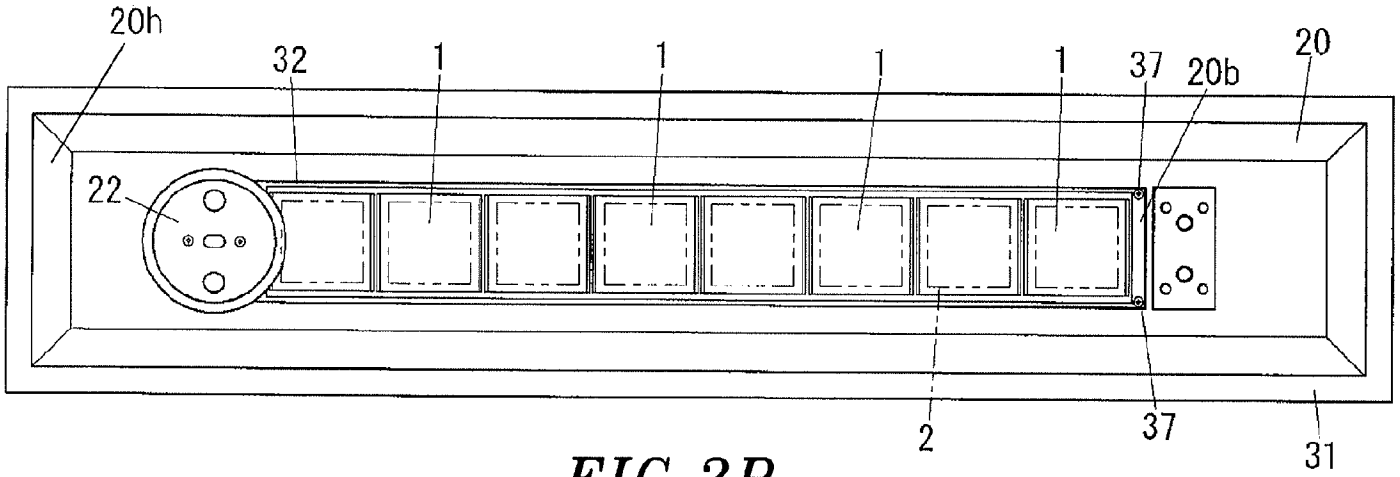
FIG. 2A is a schematic top view of the lighting device and FIG. 2B is a schematic bottom view with a second protection cover partially cut away.
Figure 2B:
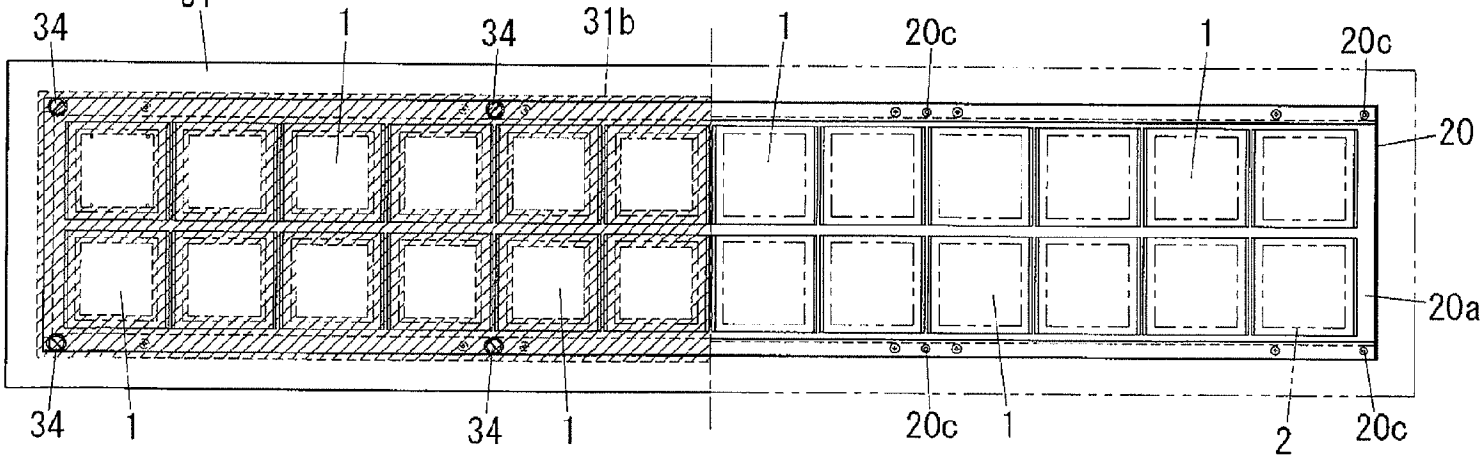
Figure 3A:
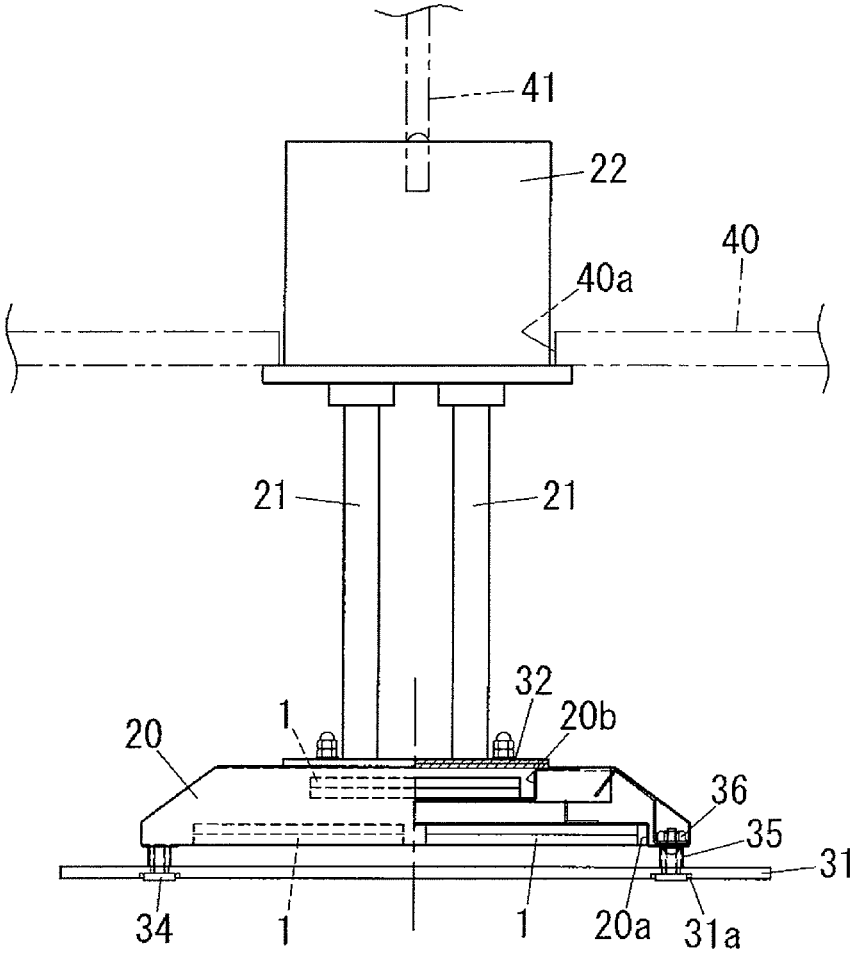
FIG. 3A is a partially cutaway schematic section view of the lighting device and FIG. 3B is an enlarged view of certain major portions of the lighting device.
Figure 3B:
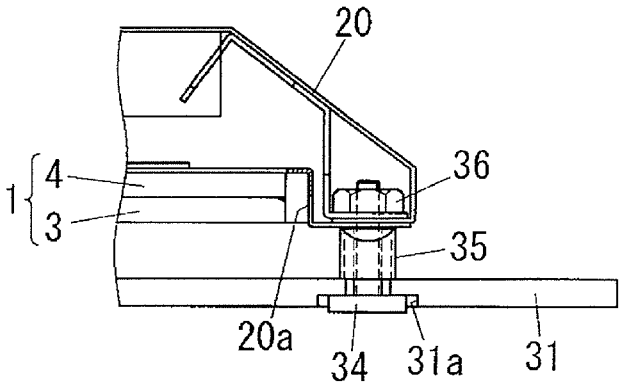

The device body 20 shown in FIGS. 2A and 2B makes up a lighting device that can be attached to a surface of a room. While the room surface is described to be a ceiling surface in the present embodiment, the room surface may be a wall surface. If the device body 20 is installed on the room surface, the rear surface of the device body 20 faces toward the room surface while the front surface of the device body 20 faces toward an inside of the room opposite to the room surface.

The distance between the rear surface of the device body 20 and the ceiling surface is smaller than the distance between the front surface of the device body 20 and the floor surface. Therefore, even if the number of the organic EL modules 1 (first EL modules) installed on the rear surface side of the device body 20 is smaller than the number of the organic EL modules 1 (second EL modules) installed on the front surface side of the device body 20, it is possible to obtain the illuminance high enough to irradiate the ceiling surface. While the number of the organic EL modules 1 arranged on the inner bottom wall of the first recess portion 20*b* is eight and the number of the organic EL modules 1 arranged on the inner bottom wall of the second recess portion 20*a* is twenty four in the lighting device of the present embodiment. In this case, for example, the length of the device body 20 becomes equal to 1349 mm and the width thereof becomes equal to 247 mm. However, the number of the organic EL modules 1 installed is not limited the illustrated one but may be selected in light of the light-emitting illuminance of the organic EL modules 1. By irradiating the ceiling surface, it is possible to maintain the brightness felt by a human in the entire space and to provide good illumination effect and mood.

In the lighting device of the present embodiment, each of the base units 4 of the respective organic EL modules 1 is attached to the inner bottom wall of each of the recess portions 20*b* and 20*a* of the device body 20 by the first attachment screw. In the present embodiment, eight organic EL modules 1 are attached to the inner bottom wall of the first recess portion 20*b* (see FIG. 2A). In the present embodiment, twenty four organic EL modules 1 are attached to the inner bottom wall of the second recess portion 20*a* (see FIG. 2B). For example, the organic EL modules 1 arranged on the inner bottom wall of the first recess portion 20*b* may be one or more rows. The organic EL modules 1 arranged on the inner bottom wall of the second recess portion 20*a* may be two or more rows. It is preferred that the rows of the organic EL modules 1 arranged in the first recess portion 20*b* and the second recess portion 20*a* are not equal to each other. This makes it possible to change the number of the organic EL modules 1 installed and to provide a difference in the light-emitting illuminance of the front and rear surfaces. By reducing the illuminance of the rear surface, it is possible to prevent glare of the ceiling surface.

The lighting devices widely used in the art are often spaced apart by about 350 to 400 mm from the ceiling surface and by about 2 to 3 m from the floor surface. In light of this fact, it can be appreciated that, even if the number of the organic EL modules 1 installed on the inner bottom wall of the first recess portion 20*b* is smaller than the number of the organic EL modules 1 installed on the inner bottom wall of the second recess portion 20*a*, it is possible to obtain the illuminance high enough to irradiate the ceiling surface. In the present embodiment, it is presumably the best mode that the organic EL modules 1 installed on the inner bottom wall of the first recess portion 20*b* are kept spaced apart by about 400 mm from the ceiling surface and by about 2.6 m from the floor surface. However, the installation distance can be arbitrarily selected in light of the light-emitting illuminance of the organic EL modules 1.

In the lighting device of the present embodiment, the organic EL modules 1 installed on the inner bottom wall of the first recess portion 20*b* are held in the device body 20 with the light-emitting surfaces of the light-emitting panels 2 facing upward. Further, the organic EL modules 1 installed on the inner bottom wall of the second recess portion 20*a* are held in the device body 20 with the light-emitting surfaces of the light-emitting panels 2 facing downward.

In this regard, it is preferred that each of the organic EL modules 1 employed in the lighting device of the present embodiment is spaced apart from the adjoining organic EL module 1 and the device body 20. In the lighting device of the present embodiment, it is therefore possible to enhance the ease of a work of replacing the light source units 3 of the organic EL modules 1.

In the lighting device of the present embodiment, plural pairs of (two pairs, in the present embodiment) hanging portions 21 capable of attaching the device body 20 to hanger bolts 41 (see FIGS. 1 and 3A) are attached to the peripheral region of the upper end portion of the device body 20. In the present embodiment, an embedment portion 22 embedded in an embedment hole 40*a* extending through the ceiling member 40 is provided in the tip end portion (the upper end portion in FIG. 1) of each pair of hanging portions 21. The embedment portion 22 can be removably attached to each of the hanger bolts 41. One pair of hanging portions 21 and one of the embodiment portions 22 are not shown in FIG. 2A. In the present embodiment, four hanger bolts 41 are installed in advance at the upper side of the ceiling member 40.

In place of the hanging portions 21, it may be possible to use a rotatable support mechanism, e.g., a support mechanism capable of adjusting the light irradiation direction.

The lighting device of the present embodiment includes a first protection cover 32 for covering the light-emitting surfaces (the upper surfaces in FIG. 1) of the light-emitting panels 2 of the organic EL modules 1 arranged on the inner bottom wall of the first recess portion 20*b* of the device body 20.

The first protection cover 32 is formed into a plate-like shape (a substantially rectangular plate-like shape in the present embodiment). In the present embodiment, the first protection cover 32 is made of a light-transmitting material. As the light-transmitting material, it is possible to use a light-transmitting resin (e.g., an acryl resin). While the light-transmitting resin is used as the light-transmitting material in the present embodiment, the present invention is not limited thereto. It may be possible to use, e.g., a glass or the like.

A plurality of (four, in the present embodiment) second attachment screw insertion holes (not shown), into which second attachment screws 37 for attaching the first protection cover 32 to the device body 20 are inserted, are formed in the peripheral portion of the first protection cover 32. Attachment screw holes 38, to which the second attachment screws 37 are threadedly coupled, are formed in the peripheral region of the upper end portion of the device body 20 in the positions corresponding to the second attachment screw insertion holes of the first protection cover 32. In the lighting device of the present embodiment, the first protection cover 32 can be attached to the device body 20 by inserting the second attachment screws 37 into the second attachment screw insertion holes of the first protection cover 32 and threadedly coupling the second attachment screws 37 to the attachment screw holes 38 of the device body 20.

The lighting device of the present embodiment includes a second protection cover 31 for covering the light-emitting surfaces (the lower surfaces in FIG. 1) of the light-emitting panels 2 of the organic EL modules 1 arranged on the inner bottom wall of the second recess portion 20*a* of the device body 20.

The second protection cover 31 is formed into a plate-like shape (a substantially rectangular plate-like shape in the present embodiment). In the present embodiment, the second protection cover 31 is made of a light-transmitting material. As the light-transmitting material, it is possible to use a light-transmitting resin (e.g., an acryl resin). While the light-transmitting resin is used as the light-transmitting material in the present embodiment, the present invention is not limited thereto. It may be possible to use, e.g., a glass or the like.

A plurality of (eight, in the present embodiment) third attachment screw insertion holes 31*a* (see FIG. 3), into which third attachment screws 34 for attaching the second protection cover 31 to the device body 20 are inserted, are formed in the peripheral portion of the second protection cover 31. Fourth attachment screw insertion holes 20*c* (see FIG. 2B), into which the third attachment screws 34 are inserted, are formed in the peripheral region of the lower end portion of the device body 20 in the positions corresponding to the third attachment screw insertion holes 31*a* of the second protection cover 31. Thread coupling portions 36 (see FIGS. 1, 3A and 3B), to which the third attachment screws 34 are threadedly coupled, are provided inside the device body 20 in the positions corresponding to the fourth attachment screw insertion holes 20*c*. In the lighting device of the present embodiment, the second protection cover 31 can be attached to the device body 20 by inserting the third attachment screws 34 into the attachment screw insertion holes 31*a* and 20*c* of the second protection cover 31 and the device body 20 and threadedly coupling the third attachment screws 34 to the thread coupling portions 36 of the device body 20.

In the lighting device of the present embodiment, a plurality of (eight, in the present embodiment) spacers 35 (see FIGS. 1, 3A and 3B) for maintaining a specified distance is arranged between the device body 20 and the second protection cover 31. Each of the spacers 35 is formed into a tubular shape (a cylindrical shape in the present embodiment). In the present embodiment, the spacers 35 may be made of, e.g., a synthetic resin material.

In the lighting device of the present embodiment, the respective spacers 35 are arranged on the center axes of the attachment screw insertion holes 31*a* and 20*c* of the second protection cover 31 and the device body 20. In the lighting device of the present embodiment, it is therefore possible to maintain a specified distance between the device body 20 and the second protection cover 31. Accordingly, the heat generated in the organic EL modules 1 arranged on the inner bottom wall of the second recess portion 20*a* of the device body 20 can be efficiently dissipated to the outside.

In the lighting device of the present embodiment, the outer periphery of the device body 20 is smaller than the outer periphery of the first protection cover 32. In the lighting device of the present embodiment, the second protection cover 31 is arranged below the device body 20. Therefore, even if the first attachment screws are removed from the organic EL modules 1 arranged on the inner bottom wall of the second recess portion 20*a* of the device body 20, it is possible to prevent the organic EL modules 1 from falling down.

The second protection cover 31 preferably includes a colored member 31*b* having the same color as the light-emitting color of the light-emitting panels 2 of the organic EL modules 1 (a white color in the present embodiment). The colored member 31*b* is arranged in a non-light-emitting region (a hatched region in FIG. 2B) of the second protection cover 31 other than a downward projection region of the light-emitting units of the organic EL modules 1 arranged on the inner bottom wall of the second recess portion 20*a* (other than a downward projection region of the regions of the light-emitting panels 2 overlapping with the first electrode, the light-emitting layers, and the second electrode) among at least the projection region of the opening surface of the second recess portion 20*a* of the device body 20. If the colored member 31*b* has a white color, the colored member 31*b* can be formed by white silk printing. Therefore, in the lighting device of the present embodiment, the non-light-emitting region becomes less noticeable when the organic EL modules 1 arranged on the inner bottom wall of the second recess portion 20*a* of the device body 20 are turned on. While the colored member 31*b* is formed by white silk printing in the lighting device of the present embodiment, the present invention is not limited thereto. For example, the colored member 31*b* may be one-piece formed with the second protection cover 31 by dual color molding.

In the lighting device of the present embodiment, the organic EL modules 1 arranged on the inner bottom wall of the first recess portion 20*b* are held in the device body 20 with the light-emitting surfaces of the light-emitting panels 2 facing upward. It is therefore possible to distribute the light toward the upper side of the device body 20. In the lighting device of the present embodiment, if the lighting device is suspended by the hanger bolts 41, the light emitted from the organic EL modules 1 arranged on the inner bottom wall of the first recess portion 20*b* of the device body 20 can be irradiated toward the lower surface of the ceiling member 40.

In the lighting device of the present embodiment, therefore, the light emitted from the organic EL modules 1 arranged on the inner bottom wall of the first recess portion 20*b* of the device body 20 can be used as indirect illumination light. In addition, the light emitted from the organic EL modules 1 arranged on the inner bottom wall of the second recess portion 20*a* of the device body 20 can be used as direct illumination light.

In the lighting device of the present embodiment, the first protection cover 32 is attached to the device body 20 so as to cover the light-emitting surfaces (the upper surfaces in FIG. 1) of the light-emitting panels 2 of the organic EL modules 1 arranged on the inner bottom wall of the first recess portion 20*b* of the device body 20. It is therefore possible to prevent dust or the like from being deposited on the organic EL modules 1 and to suppress degradation of the organic EL modules 1 (reduction of the light quantity or the shortened lifespan). In the lighting device of the present embodiment, it is therefore possible to brighten the space existing above the device body 20.

The lighting device of the present embodiment described above includes the device body 20, the organic EL modules (organic electroluminescence element module) 1 held in the device body 20 with the light-emitting surfaces of the organic electroluminescence elements facing upward, and the light-transmitting first protection cover 32 covering the upper surfaces of the organic electroluminescence element modules 1. It is therefore possible to distribute the light toward the upper side of the device body 20 and to suppress degradation of the organic electroluminescence element modules 1.

In the present embodiment, the organic EL elements are used as the light-emitting elements. The reason is that the organic EL elements are higher in diffusivity than LEDs, which makes it possible to reduce the light unevenness on the ceiling surface and the glare of the ceiling surface.

As one example, the organic EL elements are produced by forming a transparent ITO electrode as a solid electrode on a transparent glass substrate, forming an organic film including a light-emitting layer on the transparent electrode and forming an opposite electrode as a solid electrode on the organic film. The rear surface of the organic EL element including the transparent electrode, the organic film and the opposite electrode is sealed by a sealing member bonded to the peripheral region of the glass substrate. The organic EL elements used in the present embodiment have a substantially rectangular shape.

If the panel-type organic EL elements are used, the shape of the lighting device can be readily changed by changing the arrangement of the panel-type organic EL elements. This makes it possible to provide a lighting device suitable for a space. By using the organic EL elements, the thickness of the device body 20 shown in FIGS. 2A and 2B can be set equal to about 20 to 25 mm. It can be appreciated that the lighting device of the present embodiment is quite thin as compared with a high-frequency fluorescent lamp having a diameter of about 23 to 26 mm. The device body 20 shown in FIGS. 2A and 2B may have a chamfered portion 20*h* (see FIG. 2A) formed in the peripheral region of the rear surface of the device body 20. The chamfered portion 20*h* can be gripped with the fingers when cleaning the lighting device. This makes it possible to clean every corner of the lighting device. Since the lighting device of the present embodiment is formed into a flat plate shape, it is highly likely that dust or the like adheres to the lighting device. In view of this, the lighting device is formed into the shape of the present embodiment in order to seek cleaning convenience.

Use of the chamfered portion 20*h* makes the silhouette of the device body 20 look beautiful. This makes it possible to provide a lighting device harmonized with a space with no sense of weight.

A vertically movable support mechanism may be used in place of the hanging portions 21. If the lighting device is vertically movable, there is no need to perform a work in an elevated place, which makes it possible to perform a cleaning work in a safe and easy manner. If the vertically movable support mechanism is used, the height of the device body 20 can be arbitrarily adjusted for other purposes than cleaning. This makes it possible to install the device body 20 in harmony with the scene of a space.

When holding the opposite portions of the device body 20 with the hanging portions 21, the organic EL modules arranged on the inner bottom wall of the first recess portion 20*b* may be provided at the opposite outer sides of the hanging portions 21. By providing the organic EL modules at the opposite outer sides of the hanging portions 21, the shadows of the hanging portions 21 do not appear on the ceiling surface. This makes it possible to irradiate the light without marring the beauty of a space. A plurality of organic EL elements may be provided at the opposite outer sides of the hanging portions 21. In case where the hanging portions 21 exist in the central region of the lighting device, the organic EL elements may be provided at the opposite sides of the hanging portions 21.

The lighting device of the present embodiment described above can be used in a place where the beauty of a space as a whole is important.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A lighting device, comprising:

a device body adapted to be installed on a surface of a room, the device body having a first recess at an upper side of the device body and a second recess at a lower side of the device body;

first organic electroluminescence element modules including first organic electroluminescence elements, the first organic electroluminescence element modules being positioned within the first recess of the device body with light-emitting surfaces of the first organic electroluminescence elements facing toward the surface of the room when the device body is installed on the surface of the room;

a first light-transmitting protection cover positioned over the first recess so as to cover light-emitting surfaces of the first organic electroluminescence element modules;

second organic electroluminescence element modules including second organic electroluminescence elements, the second organic electroluminescence element modules being positioned within the second recess of the device body with light-emitting surfaces of the second organic electroluminescence elements facing toward an inside of the room opposite to the surface of the room when the device body is installed on the surface of the room;

a second protection cover positioned over the second recess so as to cover the light-emitting surfaces of the second organic electroluminescence element modules, the second protection cover being generally planar; and a spacer arranged between the device body and the second protection cover to maintain a specified distance between the device body and the second protection cover, wherein the number of the first organic electroluminescence element modules are smaller than the number of the second organic electroluminescence element modules.

2. The lighting device of claim 1, further comprising:

the second protection cover having a non-light-emitting region and a colored member, wherein the colored member is arranged in the non-light-emitting region and has a same color as a color of an emitting light of the second organic electroluminescence element modules.

3. The lighting device of claim 1, wherein the spacer comprises a plurality of tubular shaped spacers.

4. The lighting device of claim 1, wherein the first recess and the second recess overlap with each other in a central region of the device body.

* * * * *